United States Patent [19]

Klose

[11] 3,973,319

[45] Aug. 10, 1976

[54] COMBINED SKIN OR ROUGH TURNING AND SMOOTHING ROLLER TOOL

[75] Inventor: Ernst Klose, Achim, Uesen, Germany

[73] Assignee: Firma Gebr. Heller, Uphusen, Germany

[22] Filed: Sept. 12, 1974

[21] Appl. No.: 505,272

[30] Foreign Application Priority Data

Sept. 17, 1973 Germany .....2346729

[52] U.S. Cl. ..... 29/567; 29/90 R

[51] Int. Cl.[2] ..... B26D 1/00; B24B 39/00

[58] Field of Search ..... 29/567, 90

[56] References Cited

UNITED STATES PATENTS

| | | | |
|---|---|---|---|
| 2,056,706 | 10/1936 | Blazek et al. | 29/90 |
| 3,099,070 | 6/1963 | Morrison | 29/90 |
| 3,242,567 | 3/1966 | Adam et al. | 29/90 |
| 3,313,186 | 4/1967 | Rochon | 408/57 X |

FOREIGN PATENTS OR APPLICATIONS

| | | | |
|---|---|---|---|
| 1,088,175 | 4/1953 | France | 29/90 |
| 147,414 | 10/1962 | U.S.S.R. | 29/567 |

*Primary Examiner*—Leonidas Vlachos
*Attorney, Agent, or Firm*—Wigman & Cohen

[57] ABSTRACT

A combined skin or rough turning and smoothing roller tool comprising a body having a diametrical slit for a rough turning tool and an axially adjustable basket mounting smoothing rollers axially spaced from the slit. A frustoconically surfaced ring is disposed in an annular recess of the body forming a support surface for the rollers and the body is formed with a feed canal for a cooling-lubricant material. Outlet bores are provided in a space between the slit and the basket and communicate the feed canal with the surface of the body, the latter having a screw thread on an end adjacent the basket for a borehole feed tubing.

3 Claims, 2 Drawing Figures

COMBINED SKIN OR ROUGH TURNING AND SMOOTHING ROLLER TOOL

Figure 1:
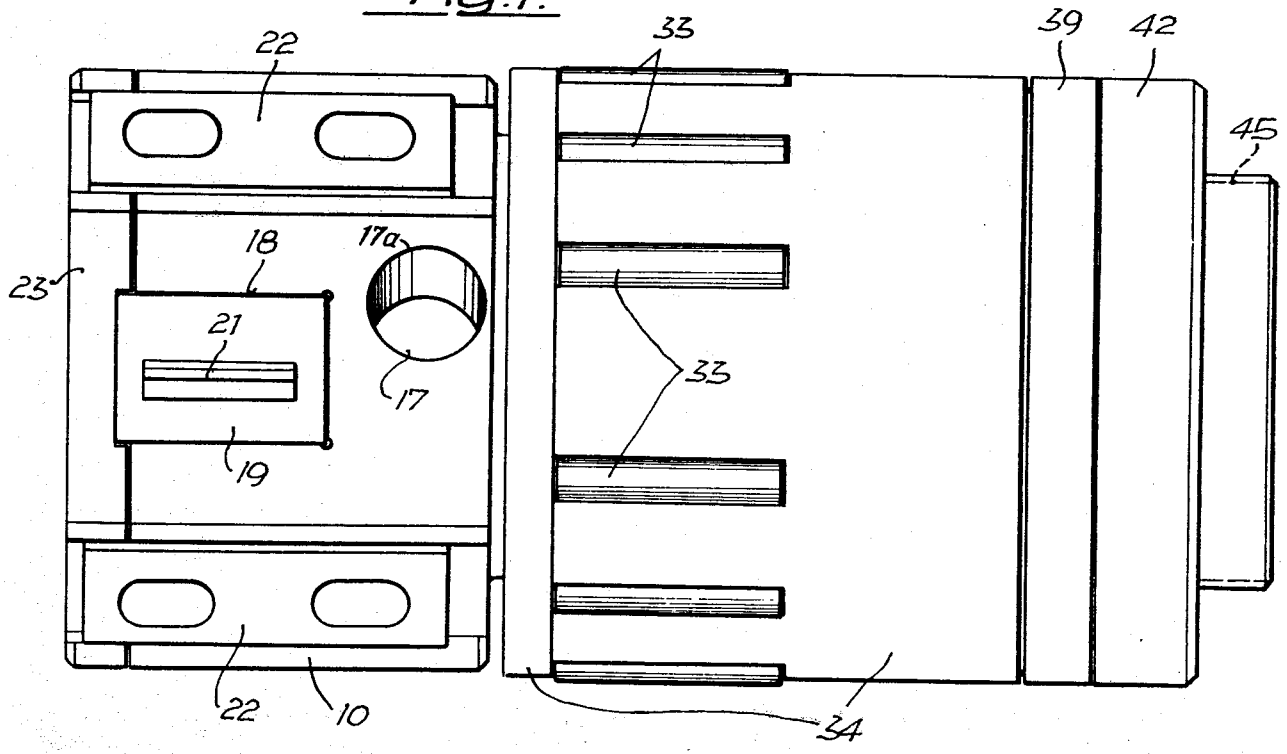

The present invention relates to a combined skin or rough turning and smoothing roller tool, in general.

The present invention relates in particular to a combined rough turning and smoothing roller tool, whose body has a diametrical slit therethrough for a diametrically moveably positioned rough turning tool, and has at an axial distance from the latter, an axially adjustable basket for rollers, as well as a supporting ring which is disposed in an annular recess of the body of the rough turning and smoothing roller tool, and forms a truncated cone shaped support surface for the rollers which serves for the smoothening rolling of a bore which has been rough turned by the rough turning tool.

Combined rough turning and smoothing roller tools of the above-mentioned types are known. They serve to bore open the wall of a bore to an exact predetermined diameter and simultaneously to smooth, polish or finish it. A rough turning tool which is diametrically moveably disposed in the diametrical continuous slit serves for the boring, the rough turning tool carrying rough turning knives on its both ends, which ends point to the surface of the body of the rough turning and smoothing roller tool. The rollers which are mounted in the basket of the rollers serve for the smoothening or finishing of the wall of the rough turned bore.

The known combined rough turning and smoothing roller tools of the above-mentioned type are inserted by means of a boring bar in the bore which is to be rough turned and smooth rolled, and are turned around their axes. With this, hereby, after the rough turning of the bore wall it is accurately smooth rolled, and the rollers in the basket of the rollers have a certain axial play, so that during insertion of the smoothing roller tool, by means of the friction between the rollers and the bore wall, they are so shifted on the frustoconically shaped support surface of the ring, such that the support surface presses the rollers with strong pressure on the bore wall.

During the rough turning and smoothening rolling, in order to cool the knives of the rough turning tool and to remove the turnings or borings, cooling lubricant material is fed to the bore by a cooling lubricant material-feed apparatus. Moreover, a sealing of the end of the bore is required, at which end the rough turning and smoothing roller tool is inserted in the bore. During admission in the bore, the cooling lubricant material flows through the annular space between the body of the rough turning and smoothing roller tool past the rollers to the rough turning tool, from where it carries away the borings which were caused during the rough turning by the rough turning tool. During the flowing-past on the rollers, the cooling lubricant material exerts an axial pressure on the rollers, by which the rollers become shifted in the direction toward the tapered end of the supporting ring, and in this manner, the pressure with which the rollers are supposed to engage against the bore wall is diminished. In this manner, yet an unobjectionable smoothening of the rough turned bore is not guaranteed.

It is a basic object and task of the present invention to provide a rough turning and smoothing roller tool, by which the rollers always with the required pressure for the smoothening rolling engage against the rough turned bore wall.

This task is solved in accordance with the present invention by, and it is an object of the present invention to so provide, a combined rough turning and smoothing roller tool of the introductory mentioned type, comprising a body having a feed canal for a cooling lubricant material, and that in the space between the slit for the rough turning tool and the basket for the rollers there are present discharge openings of exit bores for the cooling lubricant material which exit bores connect the feed canal with discharge openings on the surface of the body.

In this manner it is achieved, without the use of a separate or specialized feeding apparatus for the cooling lubricant material, that the cooling lubricant material is fed to the rough turning tool and the rollers through a borehole tubing which is connectable with the end of the body, the feed canal and the exit bores, and therethrough to the discharge openings to the annular space between the body of the rough turning and smoothing roller tool and the wall of the bore to be bored open at a position which lies between the rough turning tool and the basket for the rollers. In this manner the cooling lubricant material discharging from the discharge openings of the exit bores in the annular space, flows in opposite axial directions through the annular space, whereby the stream flowing to the rough turning tool washingly purges the borings to the end of the body adjacent to the rough turning tool, while the other stream in the opposite direction exerts a pressure on the rollers, by means of which the latter are pressed on the supporting ring in a direction opposite to the tapering of the frustoconically shaped support surface and in this manner against the wall of the bore.

By the present invention thus in a surprising way, it is attained, that by means of the feed of the cooling lubricant material exactly in manner opposite to the known way, the rollers are pressed against the bore wall by the cooling lubricant material over the truncated cone shaped support surface, so that it is always guaranteed that the rollers are pressed with a sufficient pressure on the bore wall, since now the friction between the rollers and the bore wall and the friction between the cooling lubricant material and the rollers act in the same direction.

It is another object of the present invention to provide a combined rough turning and smoothing roller tool, as set forth above, and further wherein the body comprises a receiving body in which the exit bore and the slit are seated, and a receiving sleeve in which the annular recess and the screw thread for the borehold tubing are seated. The receiving body is formed with an outer thread and the receiving sleeve has an end pointing away from the screw thread for the borehole tubing, the end of the receiving sleeve having an inner thread for screwing onto the outer thread of said receiving body. The receiving body is formed with a pocket bore complementing the hollow space of the receiving sleeve and forming therewith the feeding canal.

It is still another object of the present invention to provide a combined rough turning and smoothing roller tool, as set forth above wherein further the basket for the rollers is axially displaceably disposed on the receiving sleeve, and is formed with an inner collar. The supporting ring projects radially beyond the surface of the receiving sleeve and has an end facing away from the rough turning tool. A compression spring is supported on the end of the supporting ring and on the inner collar of the basket, the receiving sleeve being formed with an outer threading. A threaded ring having an inner threading is screwed on the outer threading of the receiving sleeve, and the compression spring presses the basket toward the threaded ring. The screw thread for attachment of the borehole tubing constitutes an inner thread.

Figure 2:
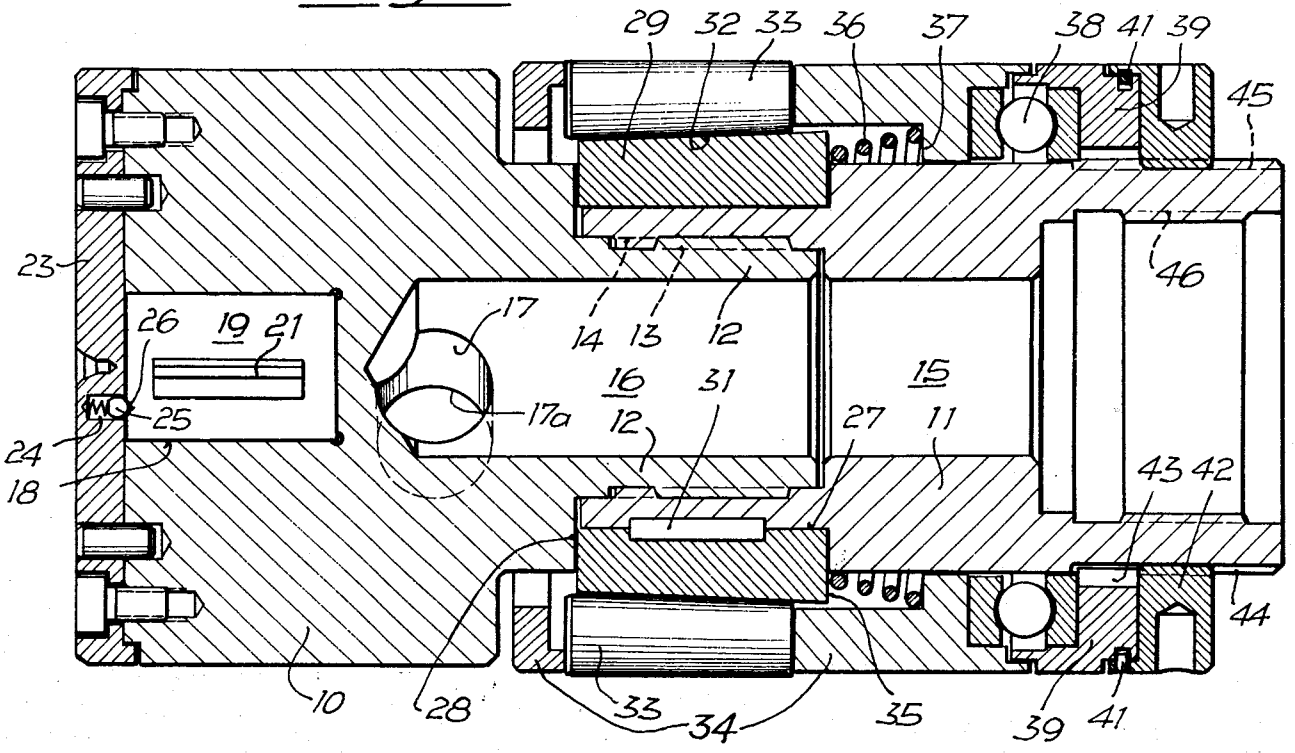

With the above and other objects in view, the present invention will become more clearly understood in connection with the accompanying drawings, and the following description, of an embodiment of a combined rough turning and smoothing roller tool in accordance with the present invention, of which:

FIG. 1 is a side view of an embodiment of a combined rough turning and smoothing roller tool in accordance with the present invention; and FIG. 2 is a diametrical section of the embodiment of FIG. 1, wherein the rough turning tool is illustrated unsectioned for clarity.

Referring now to the drawings, a combined rough turning and smoothing roller tool in accordance with the present invention comprises a body, which is composed of two parts, namely a receiving body 10 and a receiving sleeve 11. The receiving body 10, on one of its ends has a sleeve shaped projection 12, which is equipped with an outer thread 13, on which the receiving sleeve 11 with an inner thread 14 is screwed thereon. The hollow space 15 of the receiving sleeve 11 continues in a pocket bore 16 of the receiving body 10, the pocket bore 16 extending partially through the projection 12. This pocket bore 16 is connected through radial exit or outlet bores 17 with the surface of the receiving body 10, so that the hollow space 15 and pocket bore 16 form a feed canal for a cooling lubricant material. The radially outermost openings 17*a* of the outlet bores 17 on the surface of the body 10 constitute discharge openings for discharging the cooling lubricant material to the outer surface of the receiving body 10. In accordance with the invention these discharge openings 17*a* are disposed between the slit 18 and a basket 34 for the rollers to be further described herein.

A diametrically continuous slit 18 for a rough turning tool 19 is provided on an end of the receiving body 10 therethrough, which end points away, and is remote, from the receiving sleeve 11, and which rough turning tool 19 carries a rough turning knife 21 on both of its ends. Further, the receiving body 10 is equipped with four guide rails or means 22 made preferably of synthetic material, which serve for guiding of the combined rough turning and smoothing roller tool in the bore to be rough turned and smoothened by rolling. The receiving body 10 is closed off on its remote end pointing away from the receiving sleeve 11, by a centering cover 23, which has on its side facing towards the slit 18, a bore 24 for a spring loaded ball 25, which catchably engages in a corresponding recess 26 of the rough turning tool 19, in order to hold the latter yieldably in its middle position.

The receiving sleeve 11 on its end pointing toward the receiving body 10 has an annular recess 27 which is open at this end, and which together with a shoulder 28 of the receiving body 10 forms an annular recess of the rough turning and smoothing roller tool, in which a supporting ring 29 is seated, which ring is connected with the sleeve 11 by a fitting key 31. The ring 29 has a truncated cone shaped support surface 32, tapering towards the rough turning tool 19 for likewise conically truncated shaped rollers 33, which are mounted with a slight axial play in the annular basket 34 for the rollers, which basket is axially displaceably disposed on the outer surface of the receiving sleeve 11.

The ring 29 projects radially over the outer surface of the receiving sleeve 11. A compression spring 36 is supported on the projecting end 35 of the conical ring 29, which end 35 points away from the rough turning tool 19. The other end of the spring abuts against an inner collar 37 of the basket 34 for the rollers and thereby presses the basket for the rollers over an grooved thrust ball bearing 38 toward a thrust collar 39. The thrust collar 39 is unloseably yet rotatably connected relative to a threaded ring 42, by means of a spring wire 41 which respectively lies half in one groove of the thrust collar and half in one groove of the threaded ring 42. By means of a fitting key 43, which engages in an axial groove 44 of the receiving sleeve 11, the thrust collar 39 is axially displaceably connected with the sleeve. The threaded ring 42 is screwed with its inner thread on an outer thread 45 of the receiving sleeve 11. The collar 39 does not rotate, when the ring 42 is turned relative to the sleeve 11; however the collar is axially shifted via the spring wire 41 following the axial component movement of the threaded ring 42.

On its end pointing away from the receiving body 10, the receiving sleeve 11 is equipped with an inner thread 46 by means of which the receiving sleeve 11 is screwable on a borehold tubing, by means of which the combined rough turning and smoothing roller tool can be inserted in a bore to be rough turned and rolled smooth, and through which the cooling lubricant material is feedable to the place of rough turning and smooth rolling through the hollow space 15 of the receiving sleeve 11, the pocket bore 16 of the receiving body 10, the exit bores 17, and the discharge openings 17*a* to the annular space between the rough turning and smoothing roller tool and the bore wall.

In operation of the illustrated embodiment of a combined rough turning and smoothing roller tool, during rough turning and smooth rolling of a bore, the cooling - lubricant material is fed through the bore hole tubing, the feed canal formed by the hollow space 15 and the pocket bore 16, the exit bores 17, and the discharge openings 17*a* to the annular space in a range lying between the rough turning tool 19 and the rollers 33, the annular space being limited on the one hand by the receiving body 10 and the basket 34 for the rollers, and on the other hand, by the wall of the bore to be bored open, so that the cooling lubricant material primarily flows substantially axially in the direction of the rough turning tool 19 and in part axially in the opposite direction to the rollers 33. By the partial stream of the cooling - lubricant material flowing to the rough turning tool 19. The rough turning knives are cooled, and the borings produced during the rough turning are carried away toward the front. By the partial stream of the cooling - lubricant material flowing essentially axially in the direction onto the rollers 33, the rollers are lubricated and simultaneously pressed with a hyrodynamic pressure in the direction onto the widened end 35 of the truncated cone shaped support surface 32. This pressure adds to the pressure of the spring 36 and to the axial pressure caused by the friction between the rollers 33 and the wall of the bore to be bored open during the insertion of the combined rough turning and smoothing roller tool in the bore, so that by this means it is always guaranteed that the rollers 33 are pressed by the truncated cone shaped support surface radially against the bore wall.

In the illustrated embodiment example, the rollers are formed as truncated cones and have an angle of taper of the cone opposite to the support surface 32. In known manner these rollers 33 can yet also be formed barrel-shaped or also cylindrically, whereby with a cylindrical formation of the rollers 33, the axes of the rollers form an angle with an adjacent generating line of the truncated cone shaped support surface.

While I have disclosed one embodiment of the present invention, it is to be understood that this embodiment is given by example only and not in a limiting sense.

I claim:

1. A combined rough turning and smoothing roller tool, comprising a body including a front end, a back end and an outer surface having a diametrical slit extending therethrough near said front end adapted to receive a rough turning tool diametrically movably positioned therein, a plurality of rollers for rolling smooth a bore which has been rough turned by said rough turning tool, said body having an axially adjustable basket for said rollers axially spaced from said slit and extending between said slit and said back end, said body having a truncated cone support surface for said rollers tapering toward said front end, said body being formed with a pocket-like feed canal for a cooling lubricant material, said feed canal being open to said back end, discharge opening means disposed in said outer surface of said body in a space defined between said slit for said rough turning tool and said basket for said rollers, exit bore means connecting said feed canal with said discharge openings for discharging the cooling lubricant material from said canal to said outer surface of said body, screw thread means on said back end of said body for attaching a borehole tubing for the feeding of said coolant lubricant material, said body comprising a receiving body having two ends, one end of which forms said front end and in which said exit bore means and said slit are formed, and a receiving sleeve having two ends, one end of which forms said back end and in which said screw thread means for the borehole tubing is formed, said receiving body including an outer thread at the other of said two ends, the other end of said receiving sleeve including an inner thread mounted on said outer thread of said receiving body, said truncated cone support surface for said rollers comprising a ring disposed in an annular recess formed in said body, said receiving sleeve having a hollow space formed therein, and wherein said receiving body is formed with said discharge openings, with said exit bore means and with a pocket bore complementing said hollow space of said receiving sleeve and forming therewith said feeding canal.

2. The combined rough turning and smoothing roller tool, as set forth in claim 1, wherein said screw thread means for attachment of the borehole tubing constitutes an inner thread.

3. The combined rough turning and smoothing roller tool, as set forth in claim 2, wherein said basket for said rollers is axially displaceably disposed on said receiving sleeve, and is formed with an inner collar, said ring projects radially beyond the surface of said receiving sleeve and has an end facing said back end, a compression spring is supported on said end of said ring and on inner collar of said basket, said receiving sleeve is formed with an outer threading, a threaded ring having an inner threading is screwed on said outer threading of said receiving sleeve, and said compression spring presses said basket toward said threaded ring.

* * * * *